US006494135B1

(12) United States Patent
Göttling et al.

(10) Patent No.: US 6,494,135 B1
(45) Date of Patent: Dec. 17, 2002

(54) PRINTING UNIT FOR A WEB FED ROTARY PRINTING MACHINE

(75) Inventors: Josef Göttling, Friedberg; Horst Dauer, Rohrbach; Godber Petersen, Augsburg, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/634,354

(22) Filed: Aug. 9, 2000

(30) Foreign Application Priority Data

Aug. 10, 1999 (DE) ..... 199 37 805

(51) Int. Cl.[7] ..... B41F 17/06; B41F 7/02; B41F 5/04

(52) U.S. Cl. ..... 101/213; 101/220; 101/218

(58) Field of Search ..... 101/220, 181, 101/218

(56) References Cited

U.S. PATENT DOCUMENTS

| | | | | |
|---|---|---|---|---|
| 3,892,178 A | | 7/1975 | Staamann | |
| 5,063,844 A | | 11/1991 | Fausel | |
| 5,186,103 A | * | 2/1993 | Gelinas et al. | 101/181 |
| 5,341,739 A | | 8/1994 | Rogge et al. | |
| 5,351,616 A | * | 10/1994 | Gelinas et al. | 101/218 |
| 5,806,427 A | | 9/1998 | Niemiro et al. | |
| 5,868,071 A | * | 2/1999 | Niemiro et al. | 101/218 |
| 6,085,650 A | * | 7/2000 | Peterson | 101/220 |

FOREIGN PATENT DOCUMENTS

| | | |
|---|---|---|
| CH | 588 942 | 6/1977 |
| DE | 645 820 | 6/1937 |
| DE | 2 234 089 | 1/1974 |
| DE | 92 09 445.4 | 1/1993 |
| DE | 195 34 651 A1 | 3/1997 |
| DE | 198 05 889 A1 | 11/1999 |
| EP | 764 523 | 3/1997 |

* cited by examiner

*Primary Examiner*—Andrew H. Hirshfeld
*Assistant Examiner*—Marvin P Crenshaw
(74) *Attorney, Agent, or Firm*—Cohen, Pontani, Lieberman & Pavane

(57) ABSTRACT

A printing unit for a web-fed rotary printing machine is provided including a plurality of cylinders; a corresponding drive motor for each of the cylinders; a machine frame includes at least one load bearing wall, including two mutually facing wall surfaces perpendicular to a plane through end faces of the cylinders, wherein the at least one load bearing wall is arranged laterally beside an end of the cylinders; a guide means including a plurality of guide elements arranged on the at least one load bearing wall; a plurality of carriages, wherein each carriage is operably attached to at least one of the plurality of guide elements; at least one driven screw spindle mounted on the machine frame; and a permanently threaded nut engaged by an associated driven screw spindle for setting the location of the carriages.

12 Claims, 4 Drawing Sheets

PRINTING UNIT FOR A WEB FED ROTARY PRINTING MACHINE

BACKGROUND OF THE INVENTION

1. Field of the Invention

The present invention relates to a printing unit for a web-fed rotary printing machine having a plurality of printing unit cylinders that each have their own drive motor. A carriage guide means allows the cylinders to be set in relation to one another.

2. Description of the Related Art

German reference no. 195 34 651.3 discloses a printing unit having two frame walls running parallel to ends of the printing unit cylinders. The printing unit cylinders can be fitted with different diameter sleeves for altering the length of the printed image. A carriage is provided on the frame walls on both sides of the printing unit cylinder for mounting the ends of a printing unit cylinder onto the printing unit. The carriages are adjustable by means of pressure operated working cylinders. This design is relatively complicated.

SUMMARY OF THE INVENTION

The object of the present invention is to provide a generic printing unit having a simple, cost effective structure and being relatively narrow in width.

A further object of the present invention is to avoid oscillations from one printing unit cylinder from being transmitted to other printing unit cylinders via the means for setting the carriages.

Another object of the present invention is to provide long carriage guide systems to accommodate wide carriages.

The present invention is a printing unit for a web fed rotary printing machine comprising a plurality of cylinders; a corresponding drive motor for each of the cylinders; a machine frame which includes at least one load bearing wall, including two mutually facing wall surfaces perpendicular to a plane through end faces of the cylinders, wherein the at least one load bearing wall is arranged laterally beside an end of the cylinders; a guide means including a plurality of guide elements arranged on the at least one load bearing wall; a plurality of carriages, wherein each carriage is operably attached to at least one of the plurality of guide elements; at least one driven screw spindle mounted on the machine frame; and a permanently threaded nut engaged by an associated driven screw spindle for setting the location of the carriages.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, embodiments of the present invention are shown in schematic for as follows.

DETAILED DESCRIPTION OF THE PRESENTLY PREFERRED EMBODIMENTS

Figure 1:
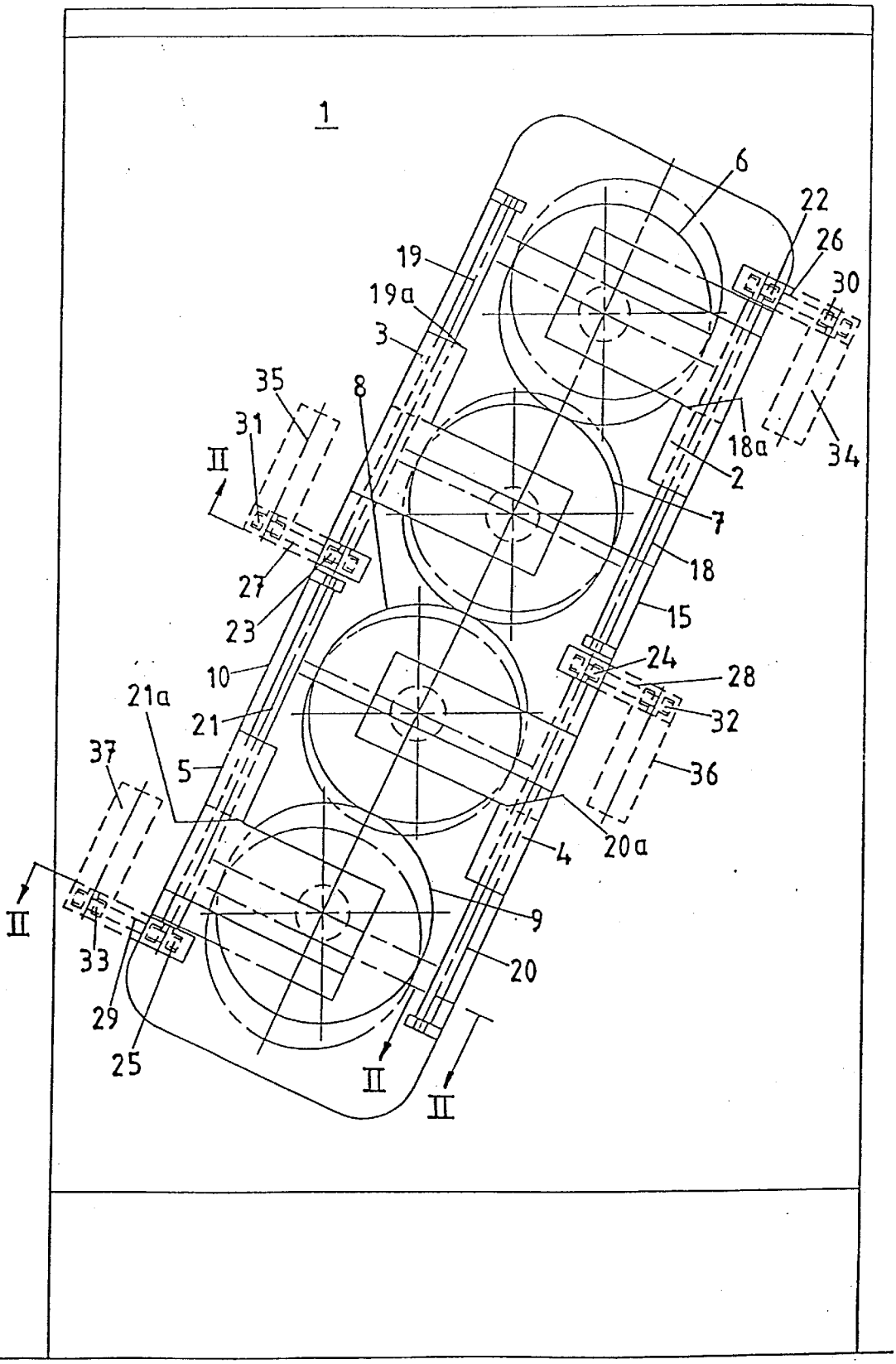
FIG. 1 is a side view of the parts of a printing unit of the present invention.

Referring now to the drawings, FIG. 1 shows a printing unit of the present invention. The printing unit has a load bearing wall 1 which is constructed as a solid wall. Latticework or the like is mounted on the wall for guiding identical carriages 2–5. The carriages 2–5 are identical in order to simplify production. Each carriage 2–5 accommodates a drive motor (not shown) and bears a printing unit cylinder 6–9. The load bearing wall 1 is arranged laterally beside the ends 11 of the printing unit cylinders 6–9. Examples of the aforementioned drive motors are disclosed in U.S. patent application Ser. No. 09/635,155.

Figure 2:
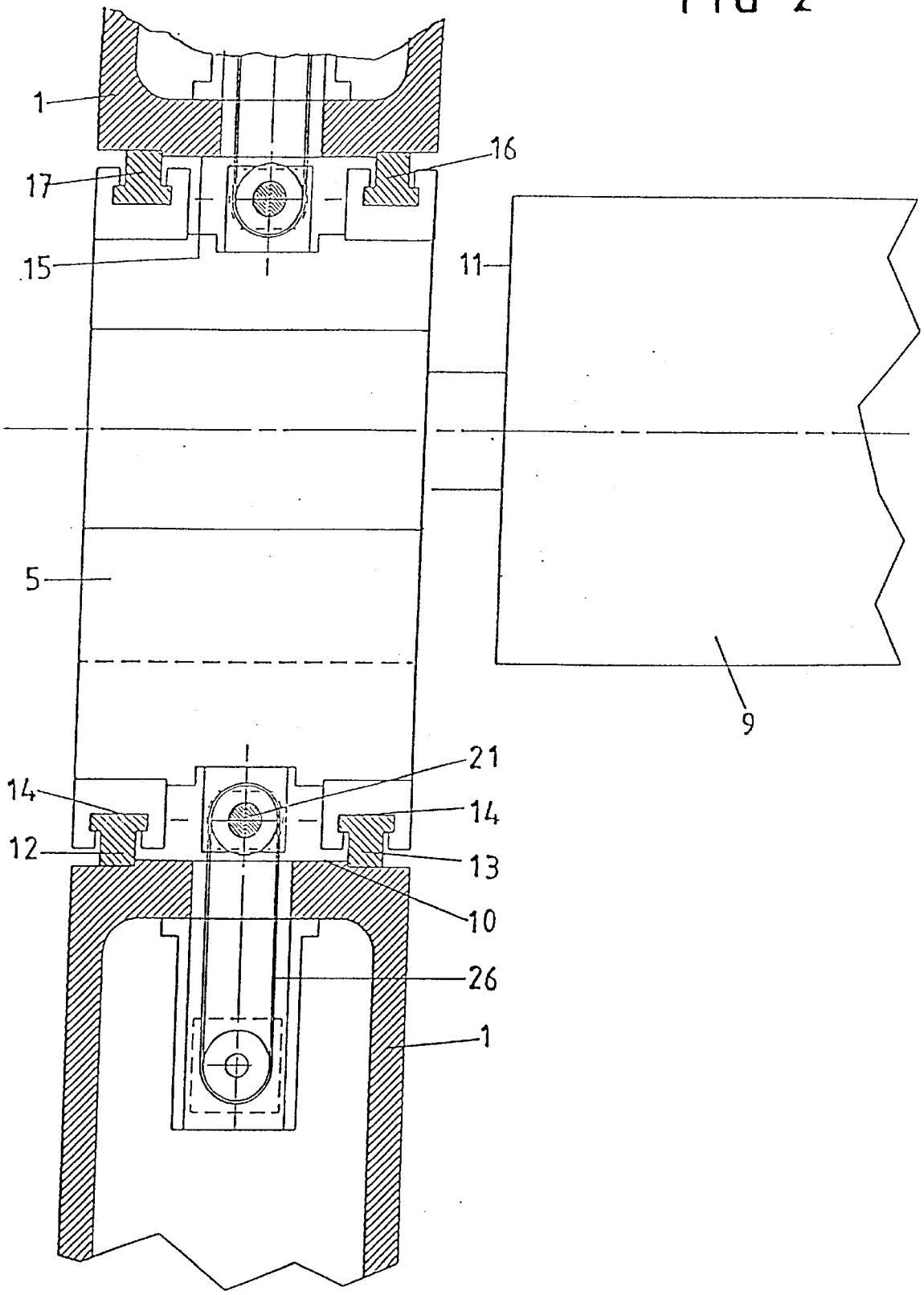
FIG. 2 is a sectional view along line II—II in FIG. 1.

Referring now to FIG. 2, the front side or surface 10 of the load bearing wall 1 bears two guide elements 12, 13 for guiding the carriage 5. The guide elements 12, 13 of this embodiment are designed like rectilinear rails having a T-shaped cross section. The main transverse part of each T-shaped cross section engages in a corresponding undercut groove 14 on the carriage 5 to provide a form fitting carriage guide system.

A further wall surface 15 is provided that is parallel to the wall surface 10 of the load bearing wall 1. The further wall surface 15 also bears rectilinear guide elements 16, 17 designed like rails having a T-shaped cross section. In addition, screw spindles 18–21 are mounted on the wall surface 10 of the load bearing wall 1 and the further wall surface 15 facing the load bearing wall 1. Each screw spindle 18–21 corresponds to a printing unit cylinder 6, 8, 7 and 9 and is mounted so that the screw spindle 18–21 may be rotated but may not be axially displaced. The guide elements 12, 13, 16 and 17 and the screw spindles 18–21 are positioned so that carriages 3 and 5 corresponding to printing unit cylinders 7 and 9 are guided on wall surface 10. Similarly, carriages 2 and 4 corresponding to printing unit cylinders 6 and 8 are guided on further wall surface 15. The carriages of printing unit cylinders that cooperate with one another, or follow one another are arranged alternately on opposite wall surfaces 10 and 15. As a result of this offset arrangement, the screw spindles 18–21 and the guide elements, for example 12, 13, 16 and 17 can be designed as long parts. This permits the grooves, such as 14, to be long as well. This configuration allows for carriages 2–5 to better absorb forces and moments that occur during operation.

Referring again to FIG. 1, each screw spindle 18–21 engages in a corresponding threaded nut 18*a*–21*a* and is fixed in a corresponding carriage 2–5. A gearwheel 22–25 is permanently fitted to one end of each screw spindle 18–21. Each gearwheel is connected by an intermediate gear system 26–29 to a further gearwheel 30–33. The intermediate gear system may, for example, be in the form of a chain or a belt drive. The further gearwheel is fitted to the output drive shaft of a setting motor 34–37 which in turn is fitted to the load bearing wall 1. The setting motors may, for example, be electric motors permanently wired on the load bearing wall 1. As mentioned previously, rather than a chain drive, a belt drive with an internal toothing system may be used to drive the gears.

FIG. 1 shows the printing unit cylinders 6–9 in the "print-on" position, where the roll are positioned in close contact. The "print-off" position is illustrated by dotted lines. For example, when changing the sleeves on the two outer printing unit cylinders 6 and 9, in this case designed as plate cylinders, printing unit cylinders 6 and 7 are moved upward. In addition, printing unit cylinders are moved downward. As a result, all of the cylinders are lifted off of one another. The setting motors 34–37 may, for example be stepping motors. By driving the setting motors 34–37 appropriately, the "print-on" and "print-off" positions of the printing unit cylinders 38–41 can be set and used during a format change.

Figure 3:
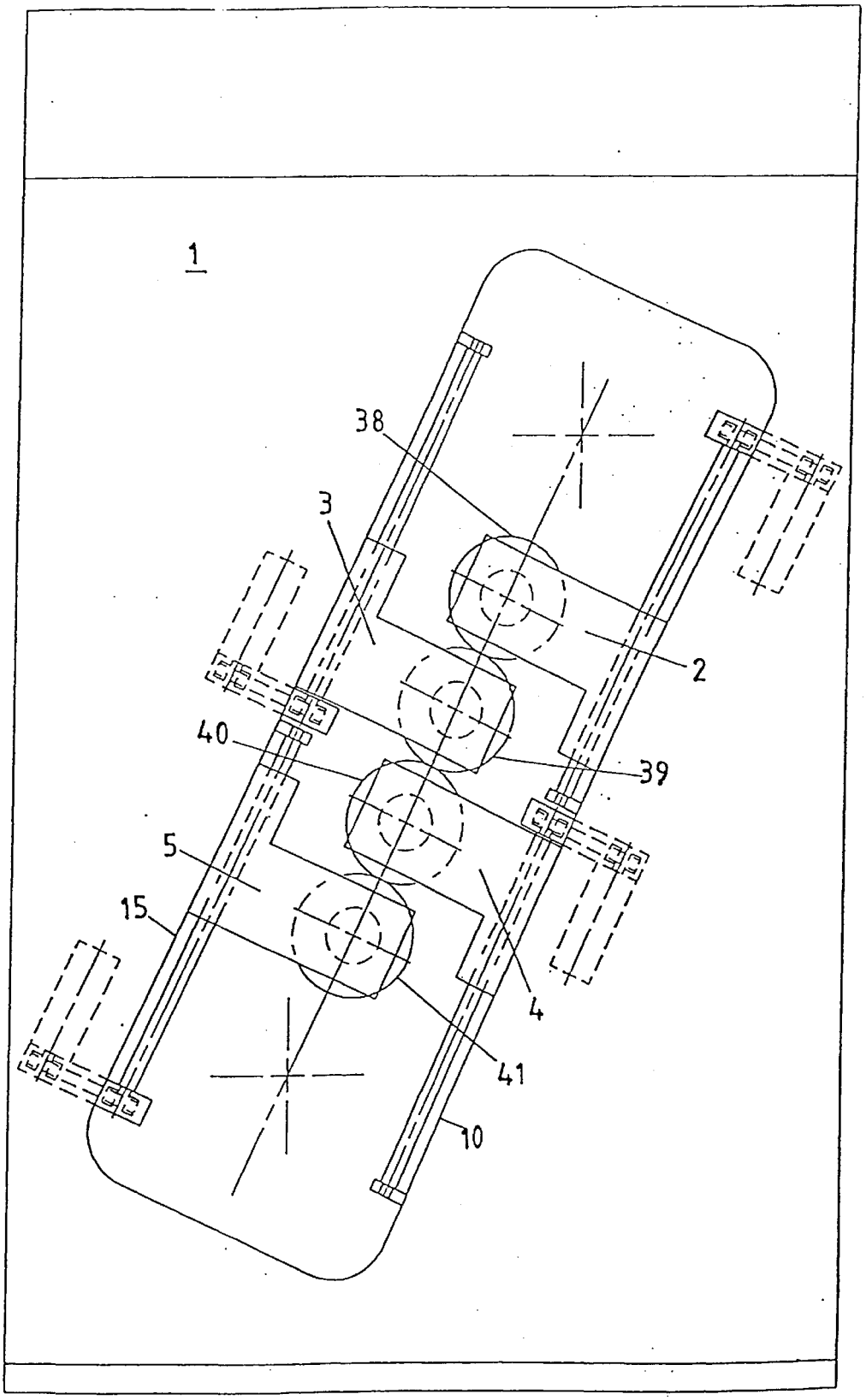
FIG. 3 is an embodiment of the present invention corresponding to FIG. 1 where the printing unit cylinders have different diameters from one another.

Referring now to FIG. 3, a second embodiment is illustrated. Carriages 2–5 may also be fitted with printing unit cylinders 38–41 having a smaller diameter than those illustrated in FIG. 1. Thus, the invention provides a single load bearing wall, carriage and carriage guide system assembly that can accommodate a variety of sizes of printing unit cylinders.

Figure 4:
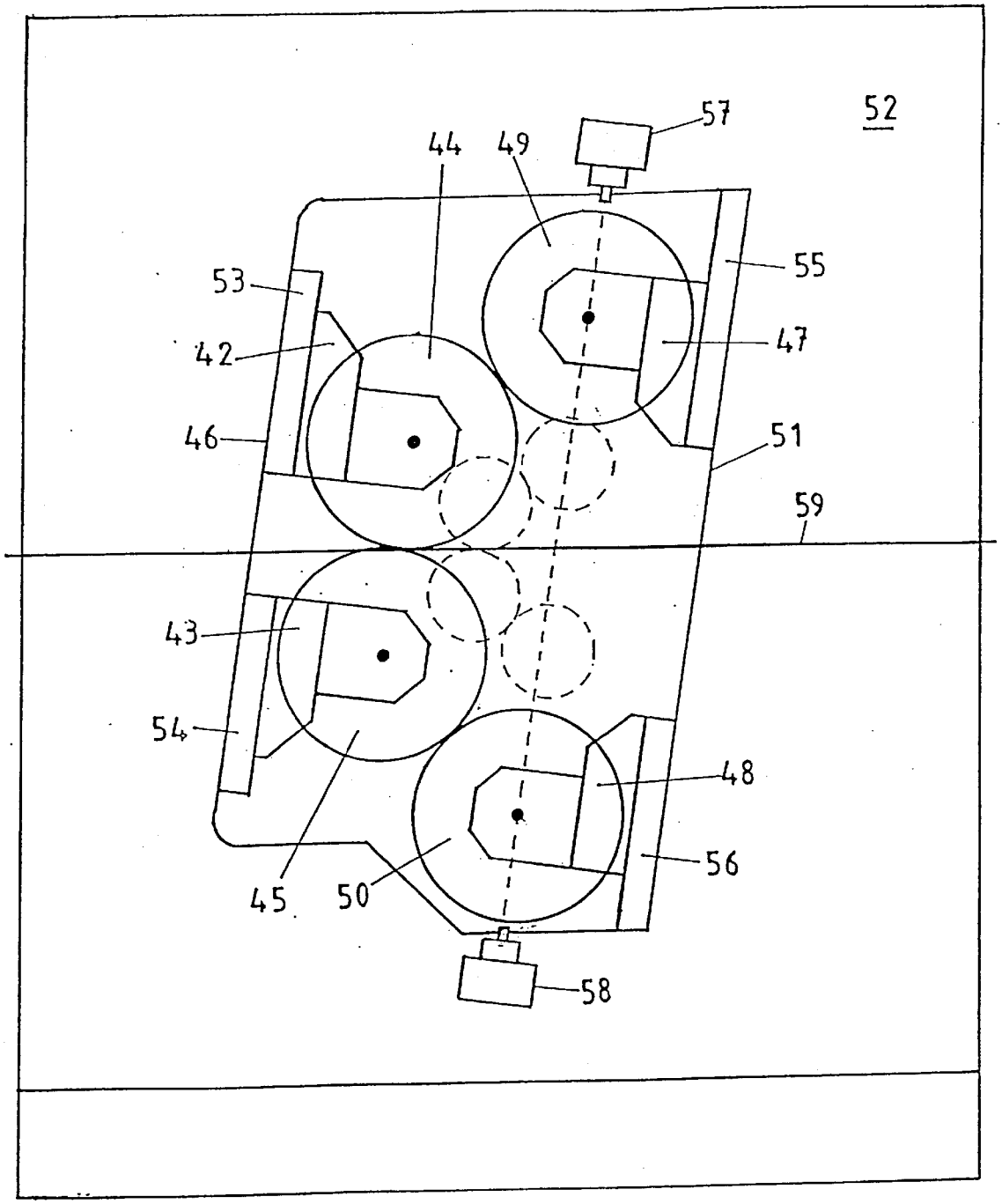
FIG. 4 is a further embodiment of the present invention corresponding to FIG. 1 here the printing unit cylinders are staggered relative to one another.

Referring now to FIG. 4, a third embodiment is illustrated. Here, the guide elements 53, 54 of two carriages 42, 43 for the inner printing unit cylinders 44, 45 are arranged on one wall surface 46. The guide elements 55, 56 of the two carriages 47, 48 for the two outer printing unit cylinders 49, 50 are arranged on a wall surface 51 of an opposing load bearing wall 52. The drive for carriages 42, 43, 47, 48 is not further illustrated because it is designed in the same manner as the previously described embodiments. In the present embodiment, carriages may be designed to be relatively long in the setting direction. Furthermore, as illustrated in FIG. 4 by the dotted lines, it is possible to use printing unit cylinders having different diameters from one another at the same time. In this case, it is possible to use a wide range of diameters of printing unit cylinders without the need to change the size of the carriage.

One example of the flexibility offered by the present invention is indicated in FIG. 4 relating to adjustments for image setting devices. In order to replace carriages 42, 43 corresponding to the inner printing unit cylinders 44, 45 with other carriages (i.e. larger carriages), while leaving carriages 47, 48 corresponding to outer printing unit cylinders 49, 50 intact, the optical axis of the image setting devices must be coplanar with the axis of their associated plate cylinder. The configuration of the present invention assures that image-setting devices 57, 58 corresponding to the outer printing unit cylinders 49, 50 (i.e. designed as plate cylinders) do not have to be adjusted with respect to the distance from the guide elements 55, 56. The image setting devices can be maintained at the same distance from the guide elements 55, 56 at all times. This permits the image setting devices to remain stationary even during carriage changes.

However, it is also possible for the image setting devices to be capable of being movable toward their respective cylinder. In this case, it is preferable for the image setting devices to be moved in relation to its corresponding plate cylinder 49, 50 in the direction of movement of the plate cylinder. Alternatively, the present invention allows for the plate cylinder 49, 50 to be moved relative to the image setting device in the image setting direction. For the purpose of the latter, the image setting devices 57, 58 can be moved on the same guide elements 55, 56 as their corresponding cylinders 49, 50. For this purpose, the guide elements 55, 56 extend as far as the image setting devices 57, 58. It is also possible to arrange further additional or auxiliary devices needed for printing on the guide elements 55, 56. For example, inking and/or damping units may be mounted so that they move on the guide elements in the same manner as explained earlier for the image setting devices. The auxiliary devices will be assigned suitable drive means such as setting motors and the like.

The ability to move the plate cylinders 49, 50 up to auxiliary devices, such as the image setting devices 57, 58, and similarly to move the image setting devices 57, 58 up to their corresponding plate cylinder 49, 50, ensures that a greatly variable and flexible format is achieved. In the case of image setting devices 57, 58, as shown, both the plate cylinder 49 and its corresponding image setting device 57 are on only one guide element. Adjustment of the cylinder and image setting device 57 is performed in the direction of the optical axis of the image setting device or the image setting direction using only one guide element. Therefore, despite there being a great deal of variability in format, in each case, only one guide element is required to perform the adjustment(s) between the plate cylinder 49, 50 and any additional device.

In the embodiments described above, the printing unit cylinders are cantilever mounted. However, they can also be mounted at both ends in a carriage. In this arrangement, a second load bearing wall must be provided having guide elements and screw spindles as provided on the load bearing wall 1. The load bearing wall in this case can be designed to be folded down to change a sleeve or cylinder or to be moved in the longitudinal direction of the cylinders. A design such as this is illustrated, for example, in U.S. patent application Ser. No. 09/635,155.

In the embodiments described above, the printing material web is guided approximately horizontally, as indicated at 59 in FIG. 4. However, any means of an appropriately rotated arrangement of the guide elements through approximately 90° is possible. Thus, it is possible for the printing units according to the present invention to perform a vertical run of the web 59.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A printing unit for a web-fed rotary printing machine, comprising:

a plurality of cylinders;

a corresponding drive motor for each of the cylinders;

a machine frame comprising two load bearing walls including a first load bearing wall positioned laterally beside one end of the cylinders and a second load bearing wall positioned laterally beside another end of the cylinders, each of the walls having two mutually facing wall surfaces perpendicular to a plane through end faces of the cylinders;

a guide means comprising a plurality of guide elements arranged on the load bearing walls;

a plurality of carriages, each carriage being operably attached to at least one of the plurality of guide elements, the cylinders having journals mounted in the carriages so that al the cylinders are movable, the cylinders being movable respectively on only one of the two mutually facing wal surfaces of each wall;

at least two driven screw spindles mounted on the machine frame; and a permanently threaded nut engaged by the associated driven screw spindle for setting the location of the carriages.

2. The printing unit according to claim 1, wherein the driven screw spindles are mounted to the load bearing walls so as to be capable of rotational movement while being fixed axially.

3. The printing unit according to claim 1, further comprising a plurality of setting motors for driving the screw spindles, one setting motor for each of the screw spindles.

4. The printing unit according to claim 1, wherein the guide elements and the screw spindles of adjacent printing unit cylinders are fitted alternately to the two mutually facing wall surfaces.

5. The printing unit according to claim 1, wherein the plurality of cylinders comprises two inner cylinders and two outer cylinders, the two inner cylinders being guided on one mutually facing wall surface and the two outer cylinders being guided on another of the two mutually facing wall surfaces.

6. The printing unit according to claim 1, wherein the guide elements are formed as rectilinear rails.

7. The printing unit according to claim 1, further comprising at least one auxiliary printing device, at least one of the cylinders being a plate cylinder, the screw spindles and the guide elements of the plate cylinder extending at least as far as the at least one auxiliary printing device.

8. The printing unit according to claim 7, wherein the guide means accommodates movement of the auxiliary printing device along the guide element corresponding to a respective plate cylinder for which the auxiliary printing device is intended.

9. The printing unit according to claim 8, wherein the guide means accommodates movement of the plate cylinder in a working direction of the auxiliary printing device.

10. The printing unit according to claim 9, wherein the auxiliary printing device comprises an image setting device, and the working direction is in an image setting direction.

11. The printing unit according to claim 9, wherein the auxiliary printing device comprises an image setting device, and the working direction is in the direction of movement of the plate cylinder.

12. The printing unit according to claim 9, wherein the auxiliary printing device comprises an image setting device, and the working direction is an image setting direction and in the direction of movement of the plate cylinder.

* * * * *